United States Patent [19]

Khalsa et al.

[11] 4,133,118

[45] Jan. 9, 1979

[54] FOOTWEAR CONSTRUCTION

[76] Inventors: Gurujot S. Khalsa; Lehri S. Khalsa, both of 1704 Q St., NW., Washington, D.C. 20009; Harbhajan S. K. Yogiji, Hacienda De Guru Ram Das, Rte. 1, Box 132-D, Espanola, N. Mex. 87532

[21] Appl. No.: 794,385

[22] Filed: May 6, 1977

[51] Int. Cl.[2] ..... A43B 13/20; A43B 13/38

[52] U.S. Cl. ..... 36/83; 36/44; 36/29

[58] Field of Search ..... 36/83, 91, 93, 28, 43, 36/44, 32 R, 104, 114, 3 B, 29

[56] References Cited

U.S. PATENT DOCUMENTS

| | | | |
|---|---|---|---|
| 3,169,326 | 2/1965 | Butera | 36/104 |
| 3,266,178 | 8/1966 | Gilkerson | 36/43 |
| 3,566,486 | 3/1971 | Conway | 36/114 |
| 3,608,215 | 9/1971 | Fukuoka | 36/29 |
| 4,020,570 | 5/1977 | Shames | 36/44 |
| 4,041,618 | 8/1977 | Famolare | 36/29 X |

FOREIGN PATENT DOCUMENTS

| | | | |
|---|---|---|---|
| 1511344 | 2/1967 | France | 36/43 |

*Primary Examiner*—Patrick D. Lawson
*Attorney, Agent, or Firm*—Wolf, Greenfield & Sacks

[57] ABSTRACT

Footwear having an inner sole formed of a resilient material with an upper surface contoured to provide a comfortable foot-supporting surface. The inner sole has an arch support region, a depressed heel cup region, a metatarsal support region, and in one embodiment, a curved low toe ridge which defines the toe region from the metatarsal support region and which extends transversely across the sole under the first phalanx of each of the toes. The insole is supported on an outer sole which has a plurality of upwardly extending ridges providing cushioning with various firmness in the different regions of the sole to compensate for the weight distribution of the foot. The inner sole and footwear upper are arranged to securely cradle the foot of the wearer.

5 Claims, 6 Drawing Figures

FIG. 4
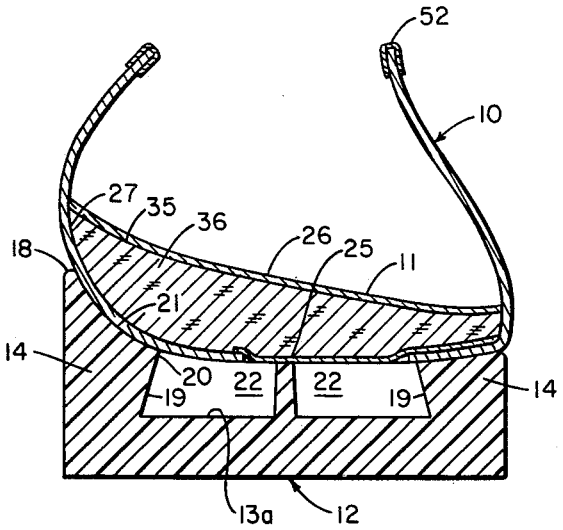
FIG. 5
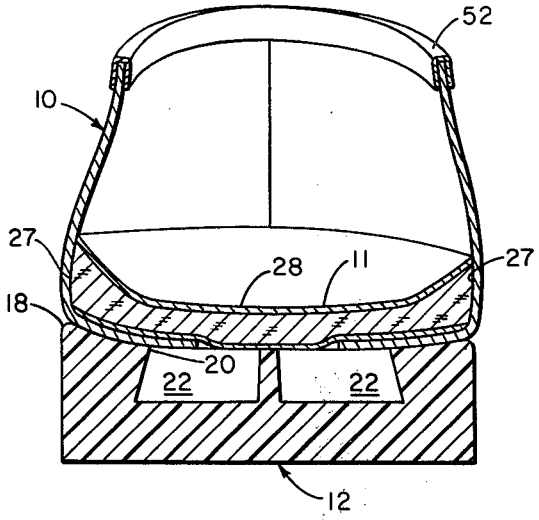
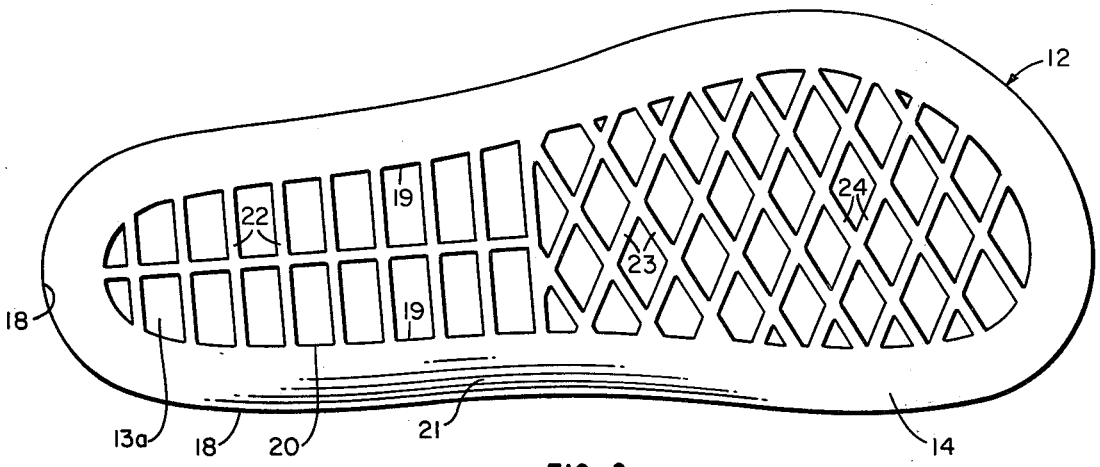
FIG. 6

FOOTWEAR CONSTRUCTION

BACKGROUND OF THE INVENTION

The present invention relates generally to footwear and more particularly relates to a shoe with a unique inner sole and outer sole construction designed to comfortably cradle the foot of the wearer. The design is specifically adapted to accommodate feet of different shapes.

Over the years there have been many attempts to design shoes that can be made economically, are comfortable to wear and properly fit a wearer's feet. In achieving these goals, certain problems exist. For example, the plantar surfaces of the feet of different people will vary in shape even though the feet may be of the same size. Thus, it is difficult to design closely conforming shoes that can be worn comfortably by a wide range of individuals having the same shoe sizes. The differences in foot contours may be exemplified by the wide variations that occur in individual arches. These variations, as others, such as longitudinal foot alignment, toe orientation and the like, present additional and substantial problems in the proper design of comfortable, close-fitting shoes that may be mass produced. Although various solutions have been proposed which are intended to solve these problems, no single design universally solves everyone's requirements.

SUMMARY OF THE INVENTION

The present invention is intended to provide a close-fitting comfortable shoe in which specially designed inner and outer soles cooperate with an upper to provide cushioned support for a wearer's foot. The sole construction comprises a combination of an inner and outer sole which is narrow at the heel and which broadens out at the toes, with a gently curved front that conforms generally with the toe line. The inner sole has an upper surface that is contoured for ideal foot support from toe to heel. In the heel region, a cuplike depression, flat at its bottom, cradles the heel. A slight rise on the outside edge of the inner sole forward of the heel assists in holding the foot stable. An arch support area rises gently to a height of approximately 1 inch above the lowest point on the upper surface of the inner sole. The arch support gently merges to a metatarsal support region which in turn is defined from the toe area by a toe ridge in one embodiment of the invention. This inner sole is of non-uniform thickness with the greatest thickness in the arch area and the thinest section in the toe area.

The inner sole, made preferably of a cork-latex composition, is supported on an outer sole of non-uniform thickness. The outer sole is made of a soft rubber-like flexible material that tapers generally from a thick heel region to a thinner sole region with an intermediate enlarged arch region. The outer sole is also provided with an upper surface having a lattice of ridges arranged and spaced to provide support of varying firmness along the length of the sole. This outer sole, in combination with the inner sole, is adapted over a time period to conform with the contours of the plantar areas of the wearer's foot. The combination of inner and outer sole also firmly supports the heel in line with the shoe while walking and further holds the foot in a stable position within the foot bed, providing a cushioned support for the foot at the instep, a gripping support for the ball of the foot and a generally level support for the plantar surface.

The upper of the shoe cooperates with the inner sole to enclose and support the side of the foot, particularly in the toe area and on the outer side of the instep region. This arrangement permits various portions of the sole to yield to varying pressures of the foot while walking, while at the same time, the foot is firmly held in the shoe and a soft and cushioned-like surface for the foot is provided.

BRIEF DESCRIPTION OF THE DRAWINGS

The foregoing objects and advantages of the present invention will be more clearly understood when considered in conjunction with the drawings in which:

FIG. 4 is a cross sectional view taken along the line 4—4 of FIG. 2;

FIG. 5 is a cross sectional view taken essentially along the line 5—5 of FIG. 3, and FIG. 6 is a cross sectional view taken essentially along the line 6—6 of FIG. 1 and illustrates the top of the outer sole.

DESCRIPTION OF THE PREFERRED EMBODIMENTS

Figure 1:
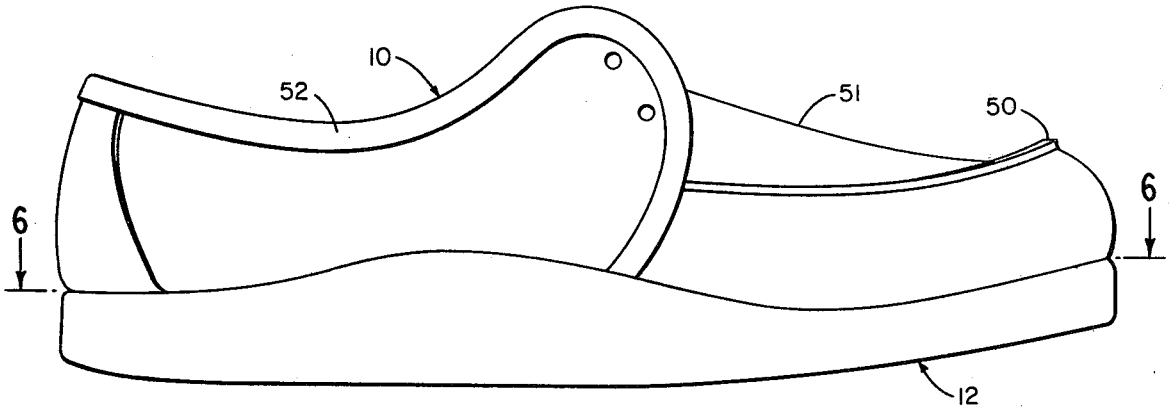
FIG. 1 is an elevational view of a shoe embodying the invention.

Referring to the drawings, there is illustrated a shoe which embodies the preferred construction of the present invention. In this arrangement, the shoe consists essentially of an upper 10, an inner sole 11, and an outer sole 12.

The outer sole 12 is made of a flexible resilient material such as rubber or synthetic rubber. This outer sole has a bottom portion 13 with a periphery generally shaped to the outline of a human foot but preferably having a comparatively broad toe region tapering from a gently curved front that conforms to the shape of the toe through an instep region to a narrower heel. A sidewall 14 extends about and upwardly from the periphery of the bottom 13. The bottom 13 and sidewall 14 have a common peripheral outer surface 16 that extends from the lower edge 17 of the bottom to the upper edge 18 of the sidewall. The sidewall 14 has an inner surface 19 that extends upwardly from the upper surface **13*a* of the bottom. The inner surface 19 terminates in an upper inner edge 20. The upper surface 21 of the sidewall has edges defined by the inner and outer edges 18 and 20, respectively. This sidewall 14 extends about the entire periphery and has a thickness of approximately ½ to ¾ of an inch. This sidewall 14 defines a recess within the bottom 13**.

The height of the sidewall 14 tapers downwardly in height from the heel to the toe region of the outer sole 12 except for the arch region. The sidewall is approximately ⅜ to ½" high at the heel and ⅛ to ¼" at the toe. The inner edge 20 is generally lower than the outer edge 18, as best illustrated in FIGS. 4 and 5. These heights which are measured from the upper surface **13*a* may vary depending on the particular application desired. In the instep region, the sidewall 14 has a height that is approximately 1" at its outer surface 16 and ½" at its inner surface 19, also as measured from the surface 13*a*. The upper surface 21 of sidewall 14 therefore is gradually inclined from the outer edge 18 of the outer surface to the inner edge 20 at the inner surface. Angle of inclination at this upper surface 21** is approximately 25° to 30° in the instep region and tapers to 10° to 15° elsewhere.

A plurality of integrally formed ridges 22, 23 and 24 extend across the upper surface 13*a* of the bottom 13 and are integrally formed with it. These ridges extend between and are integrally connected to opposite portions of the sidewall 14. The ridges 22 are uniformly spaced and extend in a parallel array from one side to the other at approximately ½" spacings. A single ridge bisects the parallel ridges and extends lengthwise of the heel and instep regions. Each of these ridges 22 has a height that tapers to the height of the adjacent portions of the inner surface 19. Thus the ridges have a height that is approximately ½" in the heel area and gradually taper downwardly to the ridges 23 in the instep area and ridges 24 in the toe area. The ridges 23 and 24 are arranged in two parallel groups angular to and bisecting one another. The ridges 23 and 24 which extend forwardly to the toe are evenly spaced and taper to an approximate height of ⅛ to ¼ of an inch in height in the toe area. The ridges 22, 23 and 24 graduate in height from the periphery to the center portion of the sole which is essentially flat.

The insole 11 comprises a unitary contoured member formed of cork-latex composition having a periphery conforming in general to but slightly smaller than the periphery of the outer sole. The insole 11 has a lower surface 25 that is essentially flat along its length from the metatarsal region to the heel region except for marginal areas along its periphery where surface 25 is convex. The upper surface 26 is generally concave. These surfaces are connected at the periphery by edge walls 27 that is wider at the heel and tapers to a narrower width at the toe end of the shoe. The edge wall 27 also tapers to a feather edge at the arch region of the shoe, as illustrated in FIG. 4. The heel region 28 of the inner sole is formed with a dish-like depression having a thickness at its center which is approximately half the thickness of the heel region at the edge wall 27. The center bottom portion of the heel region forms a flat oval shaped area approximately ½ inches wide and 2½ inches long, depending upon the shoe size. The upper surface of the inner sole surrounding the center portion 30 of the heel region is inclined from the portion 30 at an angle of approximately 20° to 30° toward the edge wall 27. Between the heel region 28 and the instep region the insole thickens with the upper surface tapering into the arch support area 35. In cross section, the arch support, best illustrated in FIG. 4 is thickest directly over the inner surface 19 of sidewall 14 on the inside edge of the instep region. From this area, the upper and lower surfaces 25, 26 both taper upwardly over the arch area of the outersole on the inside of the shoe to the edge wall 27, which at this point, is essentially a feathered edge. On the outer side of the instep region, the upper wall 26 tapers downwardly to the edge wall 27. The lower surface 25 is shaped to and conforms with the ridges and surface 22, 23, 24, and 21 in this area.

Figure 2:
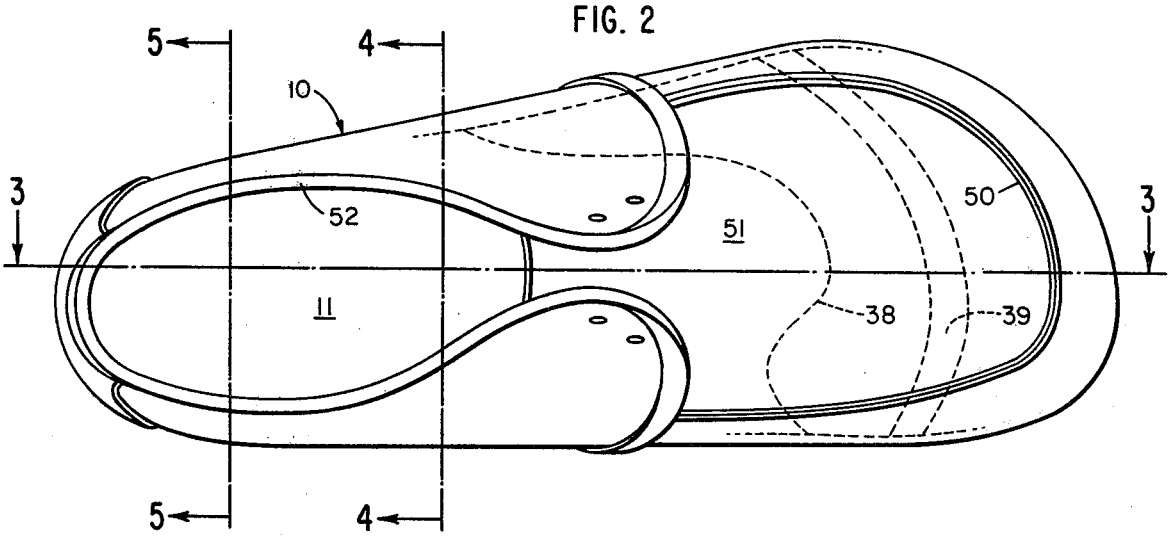
FIG. 2 is a top view of a shoe embodying the invention.
Figure 3:
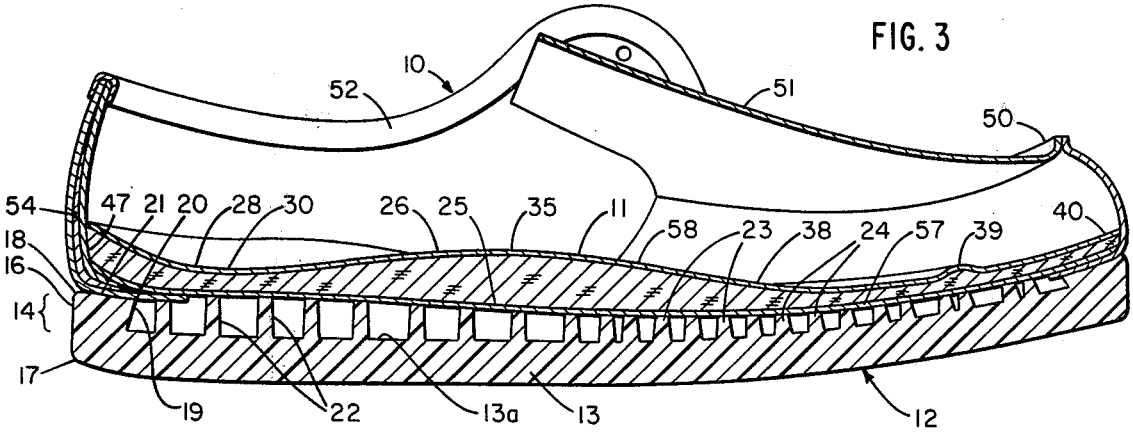
FIG. 3 is a longitudinal cross section taken along the line 3—3 of FIG. 2.

Forward of the arch support located approximately midway between the outside edges of the upper surface is a metatarsal support generally indicated at 38 in FIGS. 2 and 3. This metatarsal support area 38 tapers from and is an extension of the arch support 35 and defines a support for the metatarsal bones.

Approximately 1½ inches forward of the metatarsal support 38, in a preferred embodiment, is toe ridge 39. This toe ridge 39 extends from one side of the shoe to the other in a slight curve. This ridge 38 is very gradual in inclination and has a height which does not exceed 3/16 of an inch above the adjacent portions of the sole and is approximately ⅜ of an inch wide. The ridge 39 extends along a curve intended to underlie the portion of the wearer's foot at the ball and toes.

In alternate embodiments, this ridge may be eliminated.

What is claimed is:

1. Footwear comprising an inner sole, outersole, and upper, said outersole integrally formed of flexible resilient material and comprising heel, toe, and arch regions, and a bottom portion, a sidewall extending about the periphery of and upwardly from said bottom, said sidewall and bottom having a common peripheral outer surface extending from the lower edge of said bottom to upper outer edge of said sidewall, said sidewall having an inner surface extending upwardly from said bottom and terminating in an upper inner edge, said sidewall having an upper surface defined by said inner and outer edges, said common peripheral outer surface have a height at the arch region of approximately twice the height at the heel and toe regions, a plurality of elongated ridges integrally formed in said bottom portion and extending across the upper surface of the bottom portion between opposite portions of said sidewall, said ridges at the instep region tapering from the arch side to a lower height on the opposite side and with said ridges at the arch region greater than the height of the ridges at the heel and toe regions.

2. Footwear as set forth in claim 1 wherein said inner sole has a lower surface, with a concave transverse cross section and an upper surface with a convex transverse cross section at the instep region and with the side edge of the insole higher at the arch region than at the side opposite thereto.

3. Footwear as set forth in claim 2 wherein said inner sole is provided with a heel pocket, said heel pocket defined by a dish like depression which at its center is less than the thickness at the periphery thereof, an arch support area which is thickest over the underlying portion of said sidewall, a metatarsal which tapers from said arch support area and a toe ridge projecting upwardly along a curve extending from one side to the other of said inner sole.

4. Footwear construction including an upper, inner sole and outer sole, said inner sole having a generally concave upper surface and convex lower surface and defining a resilient cushion adapted in combination with said upper to cradle the wearer's foot, said inner sole having its greatest thickness in the arch area, said outer sole having an upper surface with resilient means supporting said inner sole including an arch area directly underlying said arch area of said inner sole.

5. Footwear as set forth in claim 4, wherein said resilient means includes a plurality of upwardly extending ridges which taper in height from the heel to the toe except in said arch area wherein said ridges are of greater height than said heel or toe areas.

* * * * *